United States Patent [19]

Stupp et al.

[11] 4,349,410

[45] Sep. 14, 1982

[54] METHOD OF MANUFACTURING A PYROELECTRIC VIDICON TARGET, APPARATUS FOR PRACTICING THE METHOD, AND A PYROELECTRIC TARGET MANUFACTURED BY THE METHOD

[75] Inventors: Edward H. Stupp, Spring Valley; Joseph Lalak, Briarcliff Manor, both of N.Y.

[73] Assignee: North American Philips Corporation, New York, N.Y.

[21] Appl. No.: 200,714

[22] Filed: Oct. 27, 1980

[51] Int. Cl.[3] ..... C23F 1/04

[52] U.S. Cl. ..... 156/654

[58] Field of Search ..... 156/654, 643, 656, DIG. 113; 313/388

[56] References Cited

U.S. PATENT DOCUMENTS 4,018,638 4/1977 Singer et al. ..... 156/626

FOREIGN PATENT DOCUMENTS 302992 6/1972 U.S.S.R. ..... 313/388

*Primary Examiner*—Stanley S. Silverman

*Attorney, Agent, or Firm*—Marc D. Schechter

[57] ABSTRACT

A method of manufacturing a target from a pyroelectric material exhibiting ferroelectric domains includes the steps of poling the target in a uniform direction and then etching a central region of the target to produce a thin target with a thick support rim around an outer edge. An apparatus for poling wafers of pyroelectric material includes two electrodes spaced a fixed distance apart by an electrode separator. The pyroelectric material is mounted in the separator at a fixed position between the electrodes. An electrically insulating liquid dielectric fills the spaces between the electrodes and the pyroelectric material in order to maximize the electric field across the material. A pyroelectric target produced by poling prior to etching exhibits reduced surface anomolies and improved image quality.

7 Claims, 1 Drawing Figure

METHOD OF MANUFACTURING A PYROELECTRIC VIDICON TARGET, APPARATUS FOR PRACTICING THE METHOD, AND A PYROELECTRIC TARGET MANUFACTURED BY THE METHOD

BACKGROUND OF THE INVENTION

Pyroelectric vidicon camera tubes use pyroelectric targets as the image sensing elements. As disclosed in an article entitled "Theory and Characteristics of Pyroelectric Imaging Tubes" by B. Singer (appearing in a book entitled *Advances in Image and Pick-up Display*, Vol. 3, editor B. Kazan, Academic Press, 1977), a target is typically fabricated by cutting and polishing a pyroelectric crystal or ceramic into a cylindrical rod. The rod is then cut into slices which, after polishing, produce wafers of typically 30 μm thickness.

It is often desirable to reduce the thickness of such a wafer even further than disclosed in the above article, U.S. Pat. No. 4,018,638 discloses a method of reducing the thickness of a wafer of pyroelectric material by etching a central region of the wafer to produce a thin membrane having a relatively strong outer rim. This process is known as "cup etching".

Although cup-etching produces pyroelectric targets having the desired thickness and strength, the etched surfaces of targets prepared by this method frequently show lines and patterns. It has been discovered that these lines and patterns may seriously degrade the image quality in vidicon tubes which incorporate pyroelectric targets manufactured according to the process of U.S. Pat. No. 4,018,638.

SUMMRY OF THE INVENTION

It is an object of the invention to provide a method of manufacturing a pyroelectric target in which the target has the desired "cup-shaped" geometry but in which the surface of the target is clear of lines and patterns.

It is a further object of the invention to provide an apparatus for manufacturing targets according to the preceding method.

Yet another object of the invention is to provide thin pyroelectric targets having surfaces which are clear of lines and patterns.

According to the present invention, pyroelectric targets are manufactured by providing a wafer of a pyroelectric material exhibiting a ferroelectric domain structure and etching a central region of the wafer, thereby producing a thinned target with a thick support rim around an outer edge. In order to eliminate the lines and patterns which would ordinarily result from etching, the wafer is poled in a substantially uniform direction at least prior to etching.

An apparatus for poling wafers of pyroelectric material according to the present invention includes a container having first and second electrodes therein. An insulating electrode separator is provided for maintaining the electrodes at a fixed distance apart and for securing the wafer at a fixed position between the electrodes. Preferably, the wafer is immersed in an insulating liquid dielectric medium having a high dielectric constant.

BRIEF DESCRIPTION OF THE DRAWING

The FIGURE is a cross-sectional view of apparatus for poling wafers of pyroelectric material according to the method of the present invention.

DESCRIPTION OF THE PREFERRED EMBODIMENTS

Figure 1:
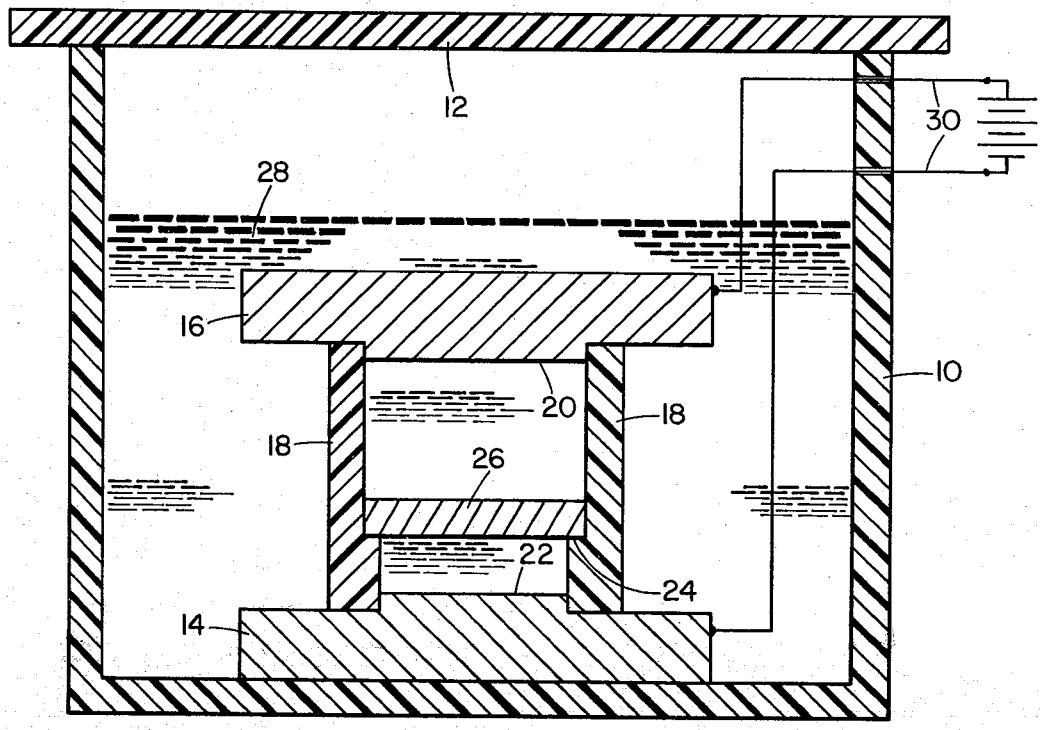

The method of the present invention starts with a wafer of pyroelectric material exhibiting ferroelectric domains. A substance which is ferroelectric exhibits spontaneous polarization, but the direction of polarization is not necessarily the same throughout the sample. Ferroelectric domains are localized volumes within the sample in which the polarization is unidirectional. The polarization directions of the different domains in the ferroelectric substance may be different. Since large electric fields exist at the domain boundaries and these fields can locally affect the rate of etching of the surface, it is desirable to eliminate the domain walls prior to the etching process.

A typical wafer, prior to etching, is shaped as a circular disc and has a diameter of 20 mm and a thickness of 150 μm. Such a wafer can be obtained, as is well known, by cutting and polishing a crystal into a cylindrical rod and then slicing the rod.

Pyroelectric materials which are suitable for use in the present invention are, for example, triglycine sulfate (TGS), deuterated triglycine fluoroberyllate (DTGFB), alanine doped triglycine sulfate, and other crystalline and polycrystalline pyroelectric materials exhibiting ferroelectric domains. The preferred material, however, is DTGFB.

The next step after obtaining the wafer is to pole the wafer in a substantially uniform direction. The phrase "to pole in a substantially uniform direction", as used in the present specification, means to align substantially all of the ferroelectric domains in a single direction. Of course, in practice, it may be impossible to align all of the ferroelectric domains in a single direction. According to the present invention, any amount of increased poling over the equilibrium state (the equilibrium state being the state having one or more domain orientations which are spontaneously achieved after a long period of time without the wafer being exposed to an external electric field) will result in an improved pyroelectric target. The more nearly the target is 100% poled prior to etching, however, the better the imaging performance of the target will be.

Poling of the target must be performed at least prior to cup-etching. The apparatus to be described below is used in such a method. Improved results would be expected by poling the target prior to and during cup-etching. However, to design an apparatus which would permit concurrent poling and cup-etching would be complex and is therefore not preferred.

One manner of poling the pyroelectric wafer is by placing the wafer in an applied electric field having at least one unidirectional field component. A unidirectional electric field component is meant to be an electric field component which at any point in space is in a single direction and has a constant sense (i.e. always positive or always negative). The pyroelectric wafer must be oriented in the field, in the case of single crystal wafers, in such a manner that a unidirectional field component is parallel to the pyroelectric axis of the wafer. In the case of polycrystalline pyroelectric wafers, one of the unidirectional field components should be perpendicular to the face of the wafer. The field, of course, need be unidirectional only in the volume in which the pyroelectric wafer is to be located.

DTGFB is an anisotropic material for which there is one preferred crystallographic orientation for the ferroelectric domains. The polar direction (i.e. pyroelectric axis) of the crystall can be determined by well known methods, such as growth morphology and X-ray analysis, and after the polar direction is found, the crystal is cut with the polar axis at a predetermined angle with respect to the face of the target wafer.

The magnitude of the applied electric field in which the wafer is placed for poling is not critical. Any magnitude of electric field will tend to pole the wafer. However, the electric field should be as strong as possible in order to pole the wafer in as short a time as possible. A realistic value for the electric field is $10^4$ volts per centimeter, although, if higher fields can be obtained without detrimental side effects, the speed of the process can be increased.

Although a pyroelectric wafer can be poled by merely placing the wafer in a unidirectional electric field, the speed of poling can be further increased by heating the wafer. The higher the temperature to which the wafer is heated (up to a maximum temperature which is slightly above the Curie temperature of the material), the quicker the wafer will become poled. The Curie temperature is a transition temperature above which a polar (ferroelectric) phase does not exist. Above the Curie temperature, the individual atoms or molecules of the substance are oriented in a nonpolar configuration and therefore ferroelectric domains do not exist. If the wafer is heated to or above its Curie temperature in an applied unidirectional electric field, upon subsequent cooling of the target below the Curie temperature the target will become poled in a substantially uniform direction.

Preferably, the wafer should be heated to a temperature between the Curie temperature and 5° C. above the Curie temperature. Once the maximum temperature is reached, the target may immediately be cooled. The wafer should not be cooled too quickly, however, to prevent cracks from forming due to thermal stresses. A cooling rate of 10° C. per minute has been found to be satisfactory.

The temperature to which the wafer is cooled after heating is not critical. However, the wafer should be cooled to as low a temperature as possible, consistent with its pyroelectric phase, in order to minimize the rate of depoling of the wafer after it is removed from the electric field. Further, when using DTGFB or other water corrosive materials, it is desirable not to cool the target below room temperature, so as to avoid condensation of water from the atmosphere thereon.

The unidirectional electric field, in which the wafer is poled, can be produced by the apparatus shown in the sole drawing FIGURE. Referring to the drawing, there is shown a container 10 having a cover 12. Inside the container are two electrodes 14 and 16 which are spaced a fixed distance apart by an elecrically insulating electrode separator 18. Preferably, electrodes 14 and 16 have plane faces 20 and 22 which are maintained parallel to one another by electrode separator 18. It is not critical, however, that the electrodes have plane, parallel faces since the electric field produced will always be unidirectional and variations in the magnitude of the field will merely effect the rate of poling.

Electrode separator 18 is made of an insulating material, such as Teflon (trademark) brand synthetic resin polymers, and is provided with a shoulder 24 upon which the pyroelectric wafer 26 is mounted between electrodes 14 and 16. Any other good electrical insulator which is not chemically attacked by the liquid dielectric, discussed below, may be used for the separator 18.

In order to maximize the electric field applied across wafer 26, container 10 is filled with a liquid dielectric 28 to a level at least as high as face 20 of electrode 16. The spaces between the electrodes 14 and 16 and wafer 26 are also filled with liquid dielectric 28.

Dielectric 28 should be choosen with as high a dielectric constant as possible in order to maximize the electric field across wafer 26. Dielectric 28 should also be a liquid which will not chemically attack the target and which will wet the wafer. It is important that the dielectric 28 wet the wafer to assure that the wafer assumes a fixed position between the electrodes and to assure that there is a relatively uniform electric field across the wafer. For the same reasons, there should be no air bubbles in the liquid dielectric 28. However, as discussed above, these factors are not critical to achieving the present invention.

A liquid dielectric which has been found to exhibit the above-described properties is nitrobenzene. This is a preferred material in terms of poling DTGFB. However, care in handling this material is necessary. Moreover, this liquid tends to dissolve moisture from the atmosphere which could atack the DTGFB crystal. To avoid this, the poling should be carried out in a dry ambient such as nitrogen.

EXAMPLE

In poling a wafer of DTGFB according to the present invention, electrode 14 is first placed in container 10 after which electrode separator 18 is placed on top of electrode 14. A small quantity of nitrobenzene is poured into the container and into electrode separator 18. After this, wafer 26 is placed in electrode separator 18 so that it is supported on shoulder 24. More nitrobenzene is poured into container 10 and into separator 18 and it is given time to wet wafer 26. Thereafter, the level of nitrobenzene is brought to above separator 18 and electrode 16 is placed on top of separator 18. Then, cover 12 is placed over container 10.

Via electrical conductors 30 (schematically shown in the drawing) a direct current electric power supply 32 is connected across electrodes 14 and 16. The polarity of the connection to the supply is not critical, but it must remain constant. The potential is preferably choosen to produce an electric field on the order of $10^4$ volts per centimeter applied. In order to achieve an electric field of this magnitude, the separation between faces 20 and 22 of electrodes 16 and 14, respectively, can be 400 $\mu$m and the applied voltage across the electrodes can be 400 volts DC. Of course, the distances shown in the drawing are not to scale.

After the electric field is applied, the pyroelectric wafer 26 can be heated by heating the entire container 10 and its contents by placing them on a heating element (not shown). The wafer 26 and the liquid dielectric 28 are heated at a controlled rate, preferably to a temperature of 80° C. This temperature is 5° C. above the Curie temperature of DTGFB (approximately 75° C. for the deuteration level used). Subsequently, the temperature is reduced at a controlled rate while the electric field is maintained. When the wafer reaches room temperature, the electric field is turned off and the wafer is removed.

Immediately after poling the wafer is cup-etched, in accordance with U.S. Pat. No. 4,018,638, discussed above, so as to minimize any depoling prior to etching. The cup-etched targets according to the present invention exhibit much reduced surface anomalies associated with ferroelectric domains and crystalographic sources and these targets result in improved image quality when incorporated in vidicon tubes.

We claim:

1. A method of manufacturing a target from a pyroelectric material exhibiting ferroelectric domains comprising the steps of:

providing a wafer of a pyroelectric material exhibiting a ferroelectrid domain structure; and etching a central region of the wafer, thereby producing a thinned target with a thick support rim around an outer edge;

characterized in that the wafer is poled in a substantially uniform direction at least prior to etching.

2. A method as claimed in claim 1, characterized in that the wafer is poled only prior to etching.

3. A method as claimed in claim 2, characterized in that the step of poling comprises placing the wafer an electric field having at least one unidirectional field component.

4. A method as claimed in claim 3, characterized in that the step of poling further comprises:

heating the wafer to a temperature at or above the Curie temperature while the wafer is in the electric field; and then cooling the wafer to a temperature substantially below the Curie temperature.

5. A method as claimed in claim 4, characterized in that the wafer is heated to a maximum temperature of 5° C. above the Curie temperature.

6. A method as claimed in claim 5, characterized in that the pyroelectric material is substantially a single crystal and has a pyroelectric axis, the unidirectional field component extends in a single direction and has a constant sense, and the step of placing the wafer in a unidirectional electric field comprises:

placing the wafer between two substantially parallel, spaced apart electrodes with the pyroelectric axis oriented parallel to at least one unidirectional field component;

filling any gaps between the electrodes and the wafer with a liquid dielectric; and applying a potential difference between the electrodes of approximately $10^4$ volts per centimeter of spacing between the electrodes.

7. A method as claimed in claim 6, characterized in that the pyroelectric material is DTGFB, the liquid dielectric is nitrobenzene, and during poling the wafer is heating to approximately 80° C. in a dry ambient.

* * * * *